US012082716B2

(12) United States Patent
Diederichs et al.

(10) Patent No.: US 12,082,716 B2
(45) Date of Patent: Sep. 10, 2024

(54) SWING DOOR SYSTEM AND A FREEZER DEVICE

(71) Applicants: SCHOTT AG, Mainz (DE); SCHOTT Flat Glass CR, s.r.o., Valaské Mezirící (CZ)

(72) Inventors: Jochen Diederichs, Mainz (DE); Petr Smajser, Štramberk (CZ); Martin Rafaj, Vsetín (CZ); Michael Lammel, Aachen (DE); Benjamin Lederhofer, Langenfeld (DE); Markus Heller, Herzogenrath (DE); Jaroslav Kukulis, Rožnov pod Radhotm (CZ); Jaroslav Placek, Zenklave (CZ)

(73) Assignees: SCHOTT AG, Mainz (DE); SCHOTT FLAT GLASS CR, S.R.O., Valasske Mezirici (CZ)

( * ) Notice: Subject to any disclaimer, the term of this patent is extended or adjusted under 35 U.S.C. 154(b) by 373 days.

(21) Appl. No.: 17/521,067

(22) Filed: Nov. 8, 2021

(65) Prior Publication Data

US 2022/0053949 A1 Feb. 24, 2022

Related U.S. Application Data

(63) Continuation of application No. PCT/EP2020/057925, filed on Mar. 23, 2020.

(30) Foreign Application Priority Data

May 6, 2019 (EP) ..... 19 172 776.7
Oct. 28, 2019 (DE) ..... 20 2019 105 965.6

(51) Int. Cl.
*A47F 3/04* (2006.01)
*A47F 3/00* (2006.01)

(52) U.S. Cl.
CPC ..... *A47F 3/043* (2013.01); *A47F 3/001* (2013.01); *A47F 3/0434* (2013.01)

(58) Field of Classification Search
CPC ..... A47F 3/043; A47F 3/001; A47F 3/0434
See application file for complete search history.

(56) References Cited

U.S. PATENT DOCUMENTS 4,223,482 A 9/1980 Barroero
4,831,780 A * 5/1989 Bockwinkel ..... F25D 23/082 49/478.1

(Continued)

OTHER PUBLICATIONS

DIN EN ISO 23953-2, "Refrigerated display cabinets—Part 2: Classification, requirements and test conditions", Sep. 2012, 90 pages.

(Continued)

*Primary Examiner* — Mark R Wendell
(74) *Attorney, Agent, or Firm* — Ruggiero McAllister & McMahon LLC

(57) ABSTRACT

The present disclosure provides a swing door system for use with a freezer device, including two adjacent swing doors and at least one mullion in contact with the swing doors. Each swing door includes a transparent pane and a non-transparent area, with each non-transparent area proximal to the mullion when the swing doors are in a closed position. The non-transparent areas and the mullion define a non-transparent region. In a plurality of horizontal see-through angles, a view through the transparent panes is not totally blocked by the non-transparent region. The horizontal see-through angle is measured with respect to the plane in which the swing doors are arranged when the swing doors are in the closed position. When a width of at least one of the swing doors is in the range of 500 mm to 780 mm, the plurality of horizontal see-through angles ranges from 6° to 174°, preferably 5° to 175°, and more preferably 4° to 176°. When a (Continued)

width of at least one of the swing doors is in the range of greater than 780 mm and equal to or lower than 1000 mm, the plurality of horizontal see-through angles ranges from 5° to 175°, preferably 4° to 176°, and more preferably 3° to 177°. A freezer device comprising a swing door system is also described herein.

22 Claims, 11 Drawing Sheets

(56) References Cited

U.S. PATENT DOCUMENTS 6,029,411 A 2/2000 Richardson
6,148,563 A * 11/2000 Roche ..... E05C 17/24 49/501
6,637,093 B2 * 10/2003 Richardson ..... A47F 3/0434 52/786.13
9,016,031 B2 * 4/2015 Chubb ..... F25D 23/087 49/478.1
9,157,675 B2 * 10/2015 Howington ..... F25D 21/04
9,890,914 B2 * 2/2018 Hannawa ..... F21V 21/005
2001/0003408 A1 6/2001 Otto
2001/0048595 A1 * 12/2001 Richardson ..... F27D 21/02 362/92
2010/0018232 A1 1/2010 Bratton
2011/0043089 A1 2/2011 Chubb
2011/0089802 A1 * 4/2011 Cording ..... A47F 3/0434 312/405
2013/0285517 A1 * 10/2013 Wach ..... A47F 3/043 49/504
2016/0166085 A1 * 6/2016 Twohy ..... A47F 3/0434 62/248
2019/0059613 A1 2/2019 Artwohl
2020/0352355 A1 * 11/2020 Diederichs ..... A47F 3/043
2022/0090846 A1 * 3/2022 Smajser ..... E06B 3/66333

OTHER PUBLICATIONS

International Search Report dated Apr. 20, 2020 for International Patent Application No. PCT/EP2020/057925, 4 pages.
Written Opinion of the International Searching Authority dated Apr. 20, 2020 for International Patent Application No. PCT/EP2020/057925, 7 pages.

* cited by examiner

SWING DOOR SYSTEM AND A FREEZER DEVICE

CROSS-REFERENCE TO RELATED APPLICATION

The present application is a continuation under 35 U.S.C. § 120 of International Patent Application No. PCT/EP2020/057925, filed on Mar. 23, 2020, which in turn claims priority to European Patent Application No. 19172776.7, filed on May 6, 2019, and German Patent Application No. 20 2019 105 965.6, filed on Oct. 28, 2019, all of which are incorporated herein by reference.

BACKGROUND OF THE DISCLOSURE

1. Field of the Disclosure

The present disclosure relates to freezer devices. More particularly, the present disclosure relates to a freezer device comprising at least one swing door system.

2. Discussion of the Related Art

Freezer devices are used for example in supermarkets and other stores for presenting frozen goods. Conventional frames and doors for freezer devices typically comprise robust and large profile structures. These structures block the view of the consumers during their shopping journey onto the presented goods in the freezer device.

In particular, conventional freezer devices comprise very large profile structures since the inner of the cabinet has to be cooled down such that frozen products, for example vegetables, frozen meat, frozen pizza, and the like can be kept inside the freezer. To enable the large temperature difference between the inner of the freezer and the ambient temperature these freezers comprise insulating and therefore bulky doors. Hence, accordingly wide and robust profiles have to be used for receiving these bulky doors and as mentioned before block a person's view to the inside of the freezer.

Embodiments of the present disclosure therefore address the problem of improving and further developing a swing door system and a freezer device such that an increased product visibility is achieved in particular when a person is accessing the device and is standing in front of the device.

SUMMARY OF THE DISCLOSURE

In an embodiment, the present disclosure provides a swing door system for use with a freezer device comprising two adjacent swing doors and at least one mullion being in contact with the swing doors, wherein each swing door comprises a transparent pane and a non-transparent area, wherein each non-transparent area is proximal to the mullion when the swing doors are in a closed position, and wherein the non-transparent areas and the mullion define a non-transparent region, wherein in a plurality of horizontal see-through angles a view through the transparent panes is not totally blocked by the non-transparent region, wherein each horizontal see-through angle is measured with respect to the plane in which the swing doors are arranged when the swing doors are in the closed position, wherein when a width of at least one of the swing doors is in the range of 500 mm to 780 mm the plurality of horizontal see-through angles ranges from 6° to 174°, preferably 5° to 175°, more preferably 4° to 176°, and/or wherein when a width of at least one of the swing doors is in the range of greater than 780 mm and equal or less than 1000 mm, the plurality of horizontal see-through angles ranges from 5° to 175°, preferably 4° to 176°, more preferably 3° to 177°.

The disclosure further discloses a mullion for a swing door system, preferably for the above-described swing door system, with a width and/or a depth of the mullion less than 70 mm, preferably less than 60 mm, more preferably less than 50 mm, and most preferably less than 45 mm.

In a further embodiment, the present disclosure provides a freezer device comprising at least one of the above-described swing door systems being arranged in a cabinet, such that the opening direction of the swing door system is horizontal.

One of the advantages of the devices of the present disclosure is that the visibility of the products is increased, especially when a person is walking by a freezer device comprising a swing door system according to the disclosure, without reducing the mechanical stability of the freezer device. Furthermore, a vertical mullion comprising a depth less than 70 mm, preferably less than 60 mm, more preferably less than 50 mm, and most preferably less than 45 mm, has the advantage that a person viewing slantwise into the freezer device has an optimized view on the stored products.

It is well known that a light ray, incident on a glass pane with two planparallel surfaces is transferred in parallel by the glass pane. However in the context of the present disclosure, such refractive effects (parallax effects) are neglected, since they are very small. In particular, refractive effects resulting from light passing through the glass panes having different refraction indices than the surrounding air, the gas-filling of a gas-filled isolated glass unit or the vacuum of an vacuum isolated glass unit are not considered when describing and calculating the see-trough angles.

The term "freezer device" refers in particular in the claims, preferably in the specification, to a device in which the temperature of the foodstuff is typically kept between −12° C. and −30° C. on normal conditions of use. Normal conditions are defined as operating conditions which exist when the cabinet, including all permanently located accessories, has been set up and situated in accordance with the recommendations of the manufacturer and is in service. Typical examples for such foodstuffs are the products which are stored according to EN23953, part 2 (September 2012) in the temperature classes L1, L2 and L3.

The term "mullion" refers in particular in the claims, preferably in the specification, to a vertical profile attached to the mounting frame of a freezer device where two adjacent doors in a freezer device meet. Traditionally, mullions have been used to create a central support surface against which the doors can rest in a sealed fashion when the doors are in a closed position.

The term "vertical side" refers in particular in the claims, preferably in the specification, to a vertical profile of the mounting frame at the outer positions of a freezer cabinet (typically left or right).

The term "horizontal profile" refers in particular in the claims, preferably in the specification, to the horizontal profile of the mounting frame of a freezer device. Typically, one upper horizontal profile and one lower horizontal profile is provided.

The term "mounting frame" refers to a support structure having upper and lower horizontal profiles, left and right vertical sides. At least a pair of reversible doors can be swingably mounted in the mounting frame in selective left-hand and right-hand opening directions.

In a cabinet, several mounting frames can be mounted. Alternatively, the horizontal profiles of one device can be arranged in a line of profiles.

It should be noted that a mullion and/or a vertical side and/or a horizontal profile can be incorporated into a cabinet structure of a freezer device.

The term "non-transparent" refers in particular in the claims, preferably in the specification, to a region, area or the like in which the view on the goods, products or the like inside the freezer device is obstructed or blocked by one or more opaque elements of the freezer device, for example by spacers, profiles, gaskets, a mullion or by the swing doors.

The skilled person understands that a person's viewing direction comprises a vertical part and a horizontal part. Therefore, the term "horizontal see-through angle" is defined by the angle between the projection of the viewing direction into a horizontal plane and the plane in which the swing doors are arranged when the swing doors are in a closed position. Furthermore, the plane in which the swing doors are arranged when the swing doors are in a closed position refers to the surface of the transparent pane outside of the freezer device.

The term "horizontal diameter" refers in particular in the claims, preferably in the specification, to a length measured in the horizontal plane in a given height. Therefore, the horizontal diameter of the non-transparent region in a given height depends on the horizontal viewing angle and describes the length of the region in which the view onto the products is blocked.

The term "width" refers in particular in the claims, preferably in the specification, to a horizontal length measured in the plane in which the swing doors are arranged when the swing doors are in the closed position. Therefore, the width of the non-transparent region corresponds to the horizontal diameter under a viewing angle of 90° with respect to the plane in which the swing doors being arranged when the swing doors are in a closed position.

The term "depth" refers in particular in the claims, preferably in the specification, to a length measured in the plane being perpendicular to the plane in which the swing doors are arranged when the swing doors are in the closed position. Therefore, the depth of the non-transparent region corresponds to the horizontal diameter under a viewing angle of 0° or 180° with respect to the plane in which the swing doors being arranged when the swing doors are in a closed position.

The term "vertical" refers in particular in the claims, preferably in the specification, to the direction aligned with the direction of the force of gravity, up or down, as materialized with a plumb line.

The term "horizontal" refers in particular in the claims, preferably in the specification, to the direction being perpendicular to the vertical direction.

In a further embodiment, the depth of the non-transparent region is less than 70 mm, preferably less than 60 mm, more preferably less than 50 mm, and most preferably less than 45 mm. The depth of the non-transparent region is preferably ranging from 25 mm to 60 mm, more preferably ranging from 25 mm to 50 mm, and most preferably from 25 mm to 40 mm. The advantage of a freezer device having an aforementioned dimensioned non-transparent region is that the visibility of the products is improved compared to state of the art solutions when the customer is viewing under an angle of approximately 45° into the freezer device.

In a further embodiment, the width of the non-transparent region is less than 70 mm, preferably less than 60 mm, more preferably less than 50 mm, and most preferably less than 45 mm. This has the advantage that the visibility of the products is improved when a customer is viewing under a viewing angle of approximately 90° into the freezer device.

According to an embodiment, the width of the non-transparent region ranging from 25 mm to 60 mm, preferably from 25 mm to 50 mm, and most preferably from 25 mm to 40 mm. A respectively dimensioned non-transparent region improves the visibility during the selection phase, i.e. when the customer stands in front of the closed swing doors. A further advantage is that a stable and mechanically reliable structure of the device is provided.

According to a further embodiment, a cross-section of the mullion is T-shaped or Y-shaped or triangle-shaped. A T-shaped mullion has the advantage of providing a very solid structure. A Y-shaped mullion has the further advantage that cabling or light fixtures can be hidden behind the mullion so that the view of a customer is not distracted by the cabling. A triangle-shaped mullion provides enhanced flexibility, e.g. it can serve as a cable duct.

According to a further embodiment, a part of the mullion reaches in between the two adjacent swing doors, when the swing doors are in the closed position. This leads to a further improved solidity and mechanical stability of the mullion. A further advantage is that the depth of the swing door system is minimized, when the mullion reaches between the adjacent swing doors. In the state of the art a mullion has the shape of a cuboid profile that comprises a cavity. These mullions achieve bending stiffness due to their large width and depth. A mullion that reaches in between the adjacent swing doors and/or has a T-shape achieves its bending stiffness due to its special design and therefore its width and depth can be smaller compared to cuboid state of the art mullions.

According to another embodiment, an insulation profile is attached to the mullion. An advantage of the insulation profile is that it insulates the mullion against the inside of a freezer device. Furthermore, the insulation profile serves to mechanical stabilize the mullion. In a further embodiment, the insulation profile is connected or attached to the mullion form-fit and/or force-fit at least at different fixation points. For example, it is possible to attach the insulation profile at different fixation points via screws and/or rivets and/or other fixation elements to the mullion. The fixation points can be arranged, preferably equidistant, at least over 80% of the height of the mullion. Furthermore, the insulation profile can be firmly bonded to the mullion. The insulation profile can be attached with an adhesive and/or an adhesive tape and/or via welding and/or via soldering at different fixation points to the mullion. In a preferred embodiment, the fixation points can be arranged, preferably equidistant, at least over 80% of the height of the mullion. Furthermore, it is possible to firmly bond the insulation profile over its whole length to the mullion.

Attaching the insulation profile to the mullion in one of the before mentioned ways has the advantage that the robustness in terms of bending stiffness is highly increased compared to a mullion that does not comprise an insulation profile.

The insulation profile can be made of plastic, preferably of a polymer, more preferably of polyvinyl chloride (PVC) or fiber reinforced plastics, or of a metal. These materials have the advantage that they have a low thermal conductivity. Furthermore, they are easy to process.

In another embodiment, the insulation profile comprises a space, for example a recess or a cavity, and the space of the insulation profile is filled with a thermally insulating material. Filling the insulation profile with a thermally insulating material has the advantage that a better thermal insulation as well as a better mechanical stabilization can be achieved. Furthermore, the insulation profile can comprise at least partly a C-shaped cross section, for encompassing the mullion. The thermal insulating material can be a foam, preferably a polyurethane (PUR) foam. A foam, especially a polyurethane foam, has the advantage that it is easy to apply to the insulation profile and that it provides excellent insulation and mechanical stabilization.

In a further embodiment, the mullion is integrally formed, at least in the region that extends from the bottom to the top of the two adjacent doors. This has the advantage that the mullion is extremely robust. Alternatively, the mullion comprises at least two elements that are coupled to each other, by form-fit and/or force-fit and/or is firmly bonded, for example welded or glued, at least in the region that extend from the bottom to the top of the two adjacent swing doors. This has the advantage that any geometry of the mullion can be manufactured easily.

According to a further embodiment, the mullion can comprise a cavity. The cavity can be used for example as a cable guide. Alternatively, the mullion can be solid, i.e. does not comprise a cavity. This has the advantage that the mullion is very robust and easy to manufacture.

According to a further embodiment, the mullion comprises at least one sealing surface, especially when the mullion has a flattened triangle shape. Alternatively, the mullion can comprise at least two sealing surfaces. Furthermore, preferably each of the two sealing surfaces can be inclined with respect to the plane in which the swing doors are arranged when the swing doors are in the closed position. Hence, the inside of the freezer can be hermetically sealed in such a way, that warm, humid air is kept from reaching the inside of the freezer when the adjacent swing doors are closed. This construction is especially advantageous when a gasket and magnetic means are provided in an area of the sealing surface because shear forces acting on the gasket during the initial phase when opening the swing doors are minimized.

According to another embodiment, a gasket is connected or attached to the mullion and/or to the insulation profile. Alternatively or additionally, a gasket can be attached to at least one of the swing doors. Providing a gasket has the advantage that the inside of the cooling device can be sealed from the outside such that humidity penetration and airflow inside of the cooling device is reduced. Preferably, the gasket can be made of polyvinyl chloride (PVC) or a thermoplastic elastomer (TPE) or Acrylnitril-Butadien-Styrol (ABS). A gasket being made of PVC or TPE or ABS has the advantage that it is very durable. In another embodiment, the gasket and the insulation profile are arranged such as to form a barrier between the mullion and the interior of the freezer device when the adjacent swing doors are in the closed position. This has the advantage that an ideal thermal isolation of the mullion against the cold air inside of the freezer device is achieved.

According to a further embodiment, magnetic means are provided for magnetically connecting the swing doors to the mullion when the doors are in the closed position. Providing magnetic means is advantageous because the sealing of the inside of the freezer device from ambient air is further improved. In a preferred embodiment, at least one permanent magnet is provided as magnetic means.

According to a further embodiment, the transparent pane of the swing door comprises a gas filled insulating glass unit (IG) or a vacuum insulated glass unit (VIG). This provides the advantage that the inside of the device being insulated against the warm ambient air. Typically, the gas filled insulating glass unit and/or the vacuum insulated glass unit comprise at least two glass panes, often three glass panes, being spaced apart from each other by one or more spacers. The glass panes can comprise a thickness of 3 mm to 5 mm, often 4 mm and/or can comprise an antifog-coating or an antifog foil and/or a heatable coating and/or a low-emissivity coating and/or an anti-reflective coating. In vacuum insulation glass units (VIG), the spacer elements can have a depth of 0.5 mm to 1.5 mm, and preferably of below 1 mm. These spacer elements of the VIG are used in combination with a circumferential edge sealing. In gas filled insulation glass units (IG), the circumferential spacer can have a depth of 4 to 20 mm. The space between the glass panes can be filled with a gas in case of an insulating glass unit (IG) or can be evacuated in case of a vacuum insulated glass unit (VIG). To not obstruct the view through the glass units, the spacers can be made of a transparent material. Generally, the transparent pane of the swing doors can comprise several glass panes one above the other.

According to a further embodiment, at least one of the swing doors is at least partly printed in the non-transparent region, preferably with a non-transparent ink. Printing the swing door in the non-transparent region is advantageous because an appealing design can be created in a cost effective way, especially by using a non-transparent ink.

According to a further preferred embodiment, the mullion is made of metal, preferably of aluminum or of steel, or of plastic, preferably of fiber reinforced plastics, or of plastic coated metal, preferably of plastic coated aluminum or of plastic coated steel or is made of a combination of the before mentioned materials in combinations with other additionally attached parts. Providing a mullion made of metal has the advantage that the mullion is very rigid. A mullion made of aluminum has the further advantage that the mullion is lightweight. Providing a mullion made of steel is advantageous in that the mullion can be used as a magnetic counterpart for magnetic means, for example a permanent magnet, so providing a magnetic lock for the swing door in embodiments in which the gasket is placed on the door. A steel mullion can be painted or otherwise coated to achieve an appealing surface and protect against corrosion. Plastic has the advantage that it can be easily processed and provides low heat conduction. A mullion made of fiber reinforced plastic is lightweight and is rigid. Covering the metal with plastic avoids corrosion of the mullion. In a further embodiment, the mullion comprises at least one opening for decreasing the mass of the structure. The mullion can comprise further elements, such as a gasket or a magnet. These elements can of course be made of a different material than the mullion.

According to a further embodiment, each swing door is at least partly surrounded by a profile, preferably by a profile with an L-shaped cross-section. For example, only one or both of the vertical sides of the swing door can comprise a profile. The profile provides a protection for the slim sides of a swing door. An L-shaped profile has the advantage that the edges of the swing door are further protected. By providing a solid profile, the profile can be manufactured easily.

In another embodiment, the gasket is arranged such as to form a barrier between the profile, for example the L-shaped profile, and the interior of the freezer when the adjacent swing doors are in the closed position. With this construction, a better insulation of the inside of the freezer against the warm ambient air is achieved.

In another embodiment, the upper edge of the front glass pane towards the shop environment is extended in a way that it closes flush or higher than the mounting frame and/or the part of the device which is facing towards the shop. By using an extended front glass, other parts of the device can be hidden which contributes to an appealing design.

In another embodiment, a heater or heating means are provided for heating at least a part of the mullion and/or at least a part of the horizontal profile/profiles, and/or wherein lighting means are provided for lighting at least a part of the cabinet. Heating the mullion and/or the horizontal profile/profiles avoids condensation by keeping the temperatures of the surfaces of these elements above the dew point. Providing a light or lighting means is advantageous in that the goods being kept inside the freezer device can be presented to the consumer appealingly. Alternatively or additionally no heating means are provided for heating the swing doors. Especially when an insulation profile is attached to the mullion a heating of the swing doors can be unnecessary.

According to another embodiment, the rotating axis of at least one of the swing doors is positioned in the non-transparent region. Arranging the rotating axis in the non-transparent region has the advantage that parts or elements for providing angular movement around the rotating axis can be hidden. Typically, the rotating axis of at least one of the swing doors is off the center with respect to the depth of the non-transparent region. This arrangement of the rotating axis enables the swing door to be prevented from being blocked in its angular movement by the mullion.

According to a further embodiment, the rotating axis is positioned in the area between the adjacent swing doors. Positioning the rotating axis in the area between the adjacent swing doors has the advantage that a blocking of the doors in prevented with easy mechanical means.

In a preferred embodiment, at least one of the swing doors comprises a hinge at opposite ends of the at least one swing door. Thereby a rotating or pivoting-type mounting of the swing door can be achieved easily, therefore installation is enhanced.

DETAILED DESCRIPTION OF THE DISCLOSURE

Figure 1:
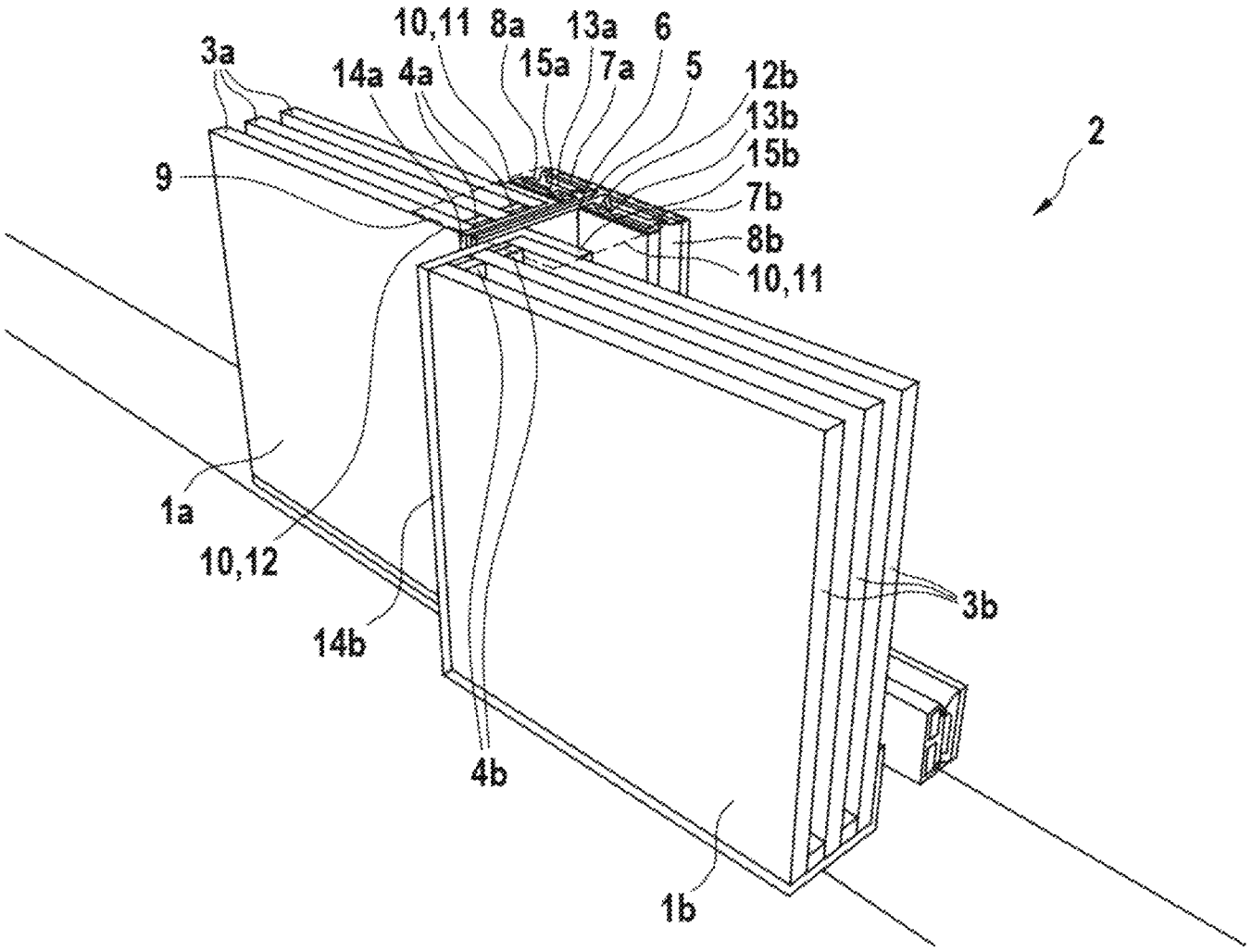
FIG. 1 shows a perspective view of a part of the adjacent swing doors of a swing door system according to an embodiment of the present disclosure.
Figure 2:
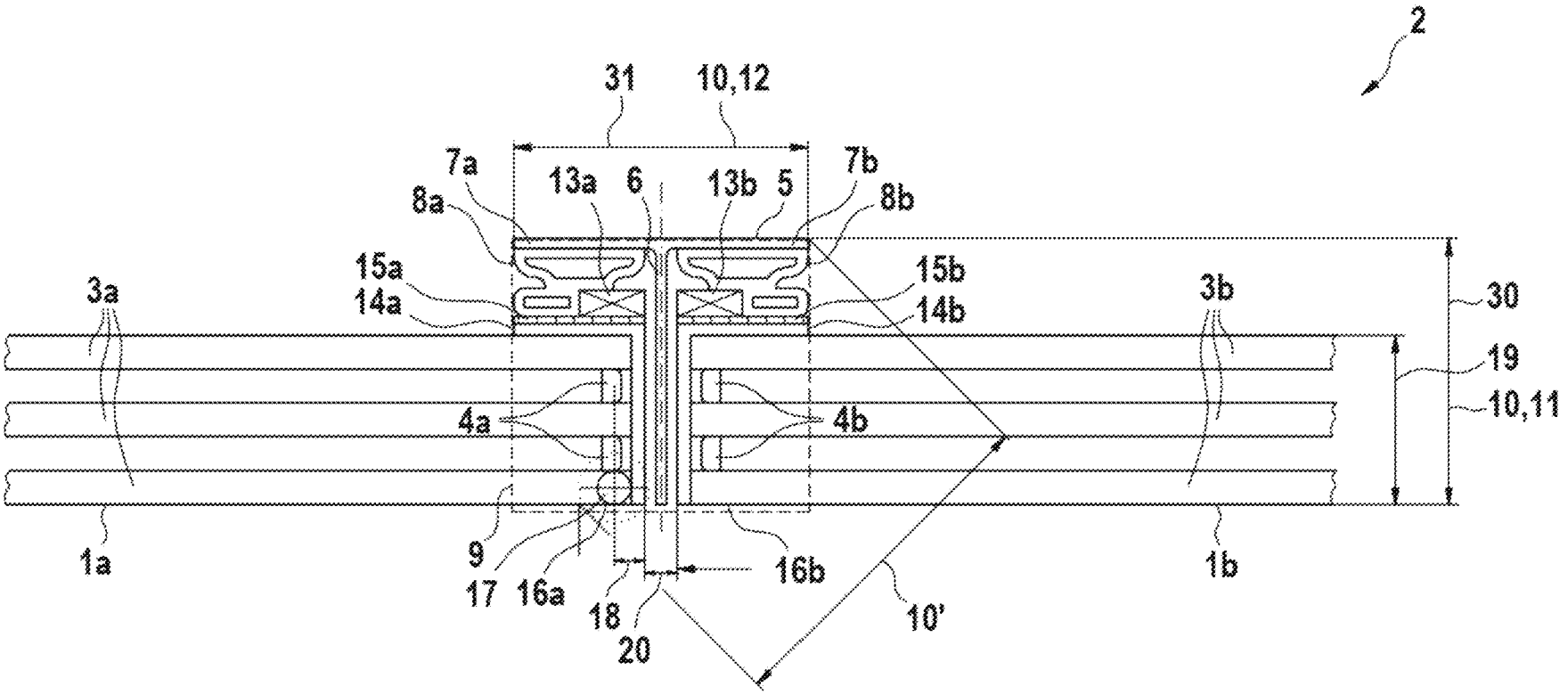
FIG. 2 shows a horizontal cross-sectional view of the swing doors system according to FIG. 1.

FIGS. 1 and 2 show different views of a part of the adjacent swing doors 1*a*, 1*b* of a swing door system 2 according to an embodiment of the present disclosure.

Each of the adjacent swing doors 1*a*, 1*b* comprises transparent panes 3*a*, 3*b*. The transparent panes 3*a*, 3*b* are spaced apart from each other by spacers 4*a*, 4*b*. The swing door system 2 further comprises a mullion 5 that has a T-shaped cross-section, and a part 6 of the mullion 5 that reaches in between the adjacent swing doors 1*a*, 1*b*, when the swing doors 1*a*, 1*b* are in the closed position. It should be noted that the part 6 can be shorter such that it does not reach in between the adjacent swing doors 1*a*, 1*b*.

FIG. 1 further shows that the mullion 5 comprises two sealing surfaces 7*a*, 7*b* each comprising a gasket 8*a*, 8*b*. Each of the swing doors 1*a*, 1*b* comprises a profile 14*a*, 14*b*, a layer 15*a*, 15*b* and a print 16*a*, 16*b* that form a non-transparent area on each swing door 1*a*, 1*b*, respectively. The non-transparent areas of the swing doors 1*a*, 1*b* are each proximal to the mullion 5 when the swing doors 1*a*, 1*b* are in the closed position. The non-transparent areas and the mullion 5 together define a non-transparent region 9 that is marked in FIGS. 1 and 2 with a dashed square. Depending on the horizontal viewing angle, the horizontal diameter 10 of the non-transparent region 9 can be different. FIG. 2 shows that the depth 11 of the non-transparent region 9 is defined as the horizontal diameter 10 of the non-transparent region 9 being viewed under an horizontal viewing angle of 0° or 180° with respect to the plane in which the swing doors 1*a*, 1*b* are arranged when the swing doors 1*a*, 1*b* are in a closed position, i.e. the right or left side of the dashed square. The width 12 of the non-transparent region 9 is defined as the horizontal diameter 10 of the non-transparent region 9 being viewed under an horizontal viewing angle of 90° with respect to the plane in which the swing doors 1*a*, 1*b* being arranged when the swing doors 1*a*, 1*b* are in a closed position. Hence, the width 12 corresponds to the front side of the dashed square.

Due to the design of the mullion 5, the depth 11 and the width 12 of the non-transparent region 9 are extremely short and correspond at least essentially to the depth 30 and width 31 of the mullion 5. Because of the low depth 11 of the non-transparent region 9, the visibility inside of the freezer device is improved when the customer is viewing slantwise into the freezer. The low width 12 of the non-transparent region 9 improves the visibility during the selection phase, i.e. when a person is standing in front of the closed swing doors 1*a*, 1*b*.

Furthermore, FIGS. 1 and 2 show that each of the gaskets 8*a*, 8*b* comprise a magnet 13*a*, 13*b*, respectively. Each magnet 13*a*, 13*b* is positioned near the part 6 of the mullion 5. A solid L-shaped profile 14*a*, 14*b* protects each of the adjacent swing doors 1*a*, 1*b*. It should be noted that the L-shaped profile 14*a*, 14*b* forms a part of the non-transparent region 9 since it blocks a person's view of the products. In the closed position of the swing doors 1*a*, 1*b*, the legs of each L-shaped profile 14*a*, 14*b* are parallel to the sealing surface 7*a*, 7*b* and part 6 of the mullion 5. Moreover, the L-shaped profile 14*a*, 14*b* comprises a layer 15*a*, 15*b* of a material, preferably of metal, for example of steel, that interacts with the magnets 13*a*, 13*b* when the swing doors 1*a*, 1*b* are in the closed position. Thereby the swing doors 1*a*, 1*b* are held securely in the closed position so that the sealing of the inside of the freezer device is improved and the swing doors 1*a*, 1*b* can still be opened easily. Instead of providing a layer 15*a*, 15*b*, the L-shaped profile 14*a*, 14*b* itself can be made of such a material that interacts with the magnets 13*a*, 13*b*.

Each of the adjacent swing doors 1*a*, 1*b* can comprise a print 16*a*, 16*b* with a non-transparent ink in the non-transparent region 10 as indicated only in FIG. 2.

According to FIG. 2, the rotating axis 17 of the left swing door 1*b* is positioned in the non-transparent region 9 with a distance 18 of 5 mm away from the external surface of the L-shaped profile 14*a*, 14*b*. With respect to the thickness 19 of the swing door 1*a*, the rotating axis 17 is off-centered, i.e. is positioned in alignment with the external transparent pane 3*a*. The depth 11 of the non-transparent region 9 is 42 mm, and the width 12 of the non-transparent region 9 is 45 mm. Further, the thickness 19 of each swing door 1*a*, 1*b* without the L-shaped profile 14*a*, 14*b* is 26 mm. The gap 20 between the swing doors 1*a*, 1*b* in the closed position is 5 mm. If a person or customer looks at a horizontal view angle of under 45° horizontally towards the non-transparent region 9 the horizontal diameter 10' of the non-transparent region 9 is 55 mm, i.e. the length defined by the left end of the print 15*a* and the right end of the sealing surface 7*b*.

Figure 3:
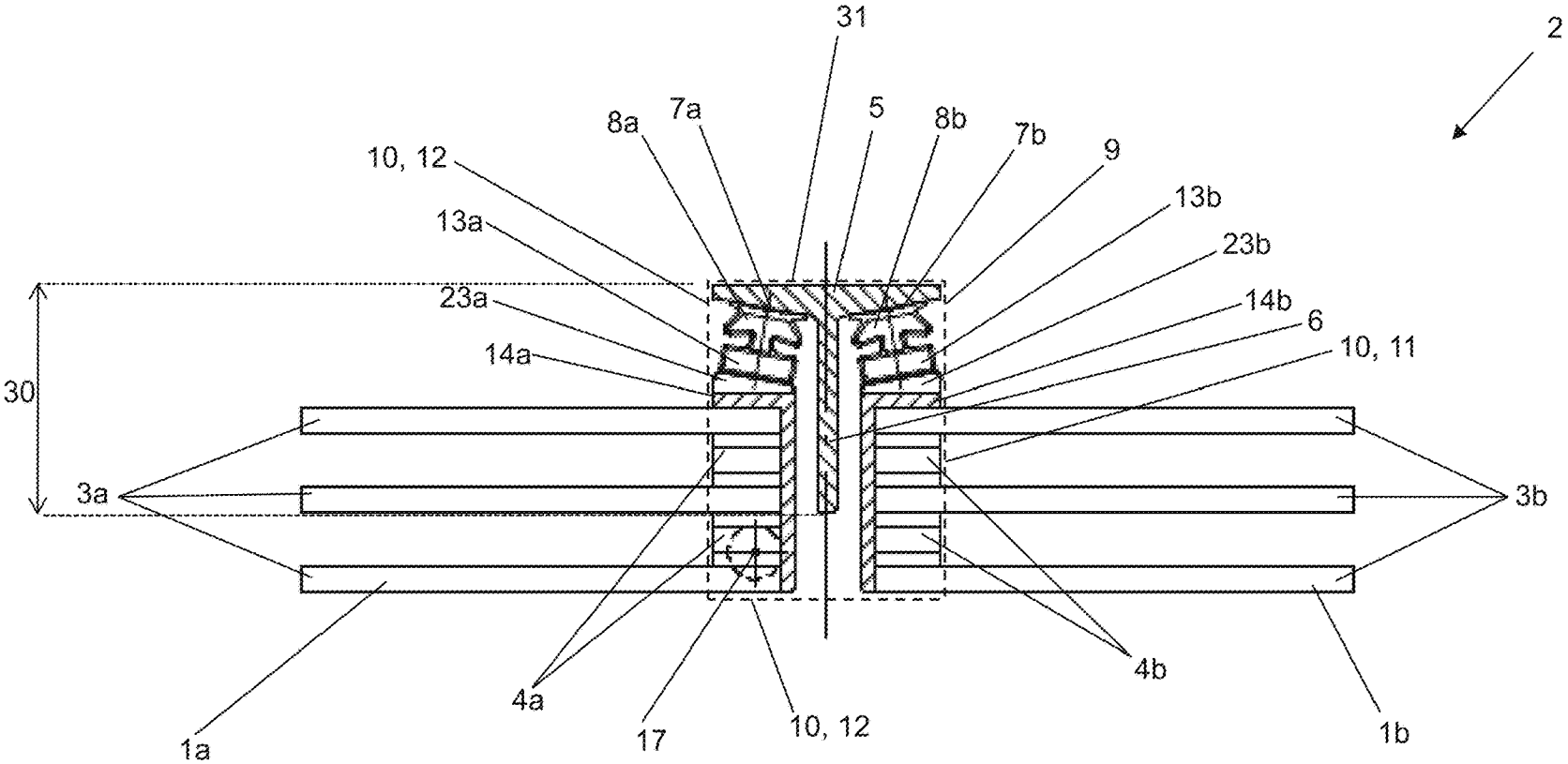
FIG. 3 shows a horizontal cross-sectional view of a swing door system according to a further embodiment of the present disclosure.
Figure 4:
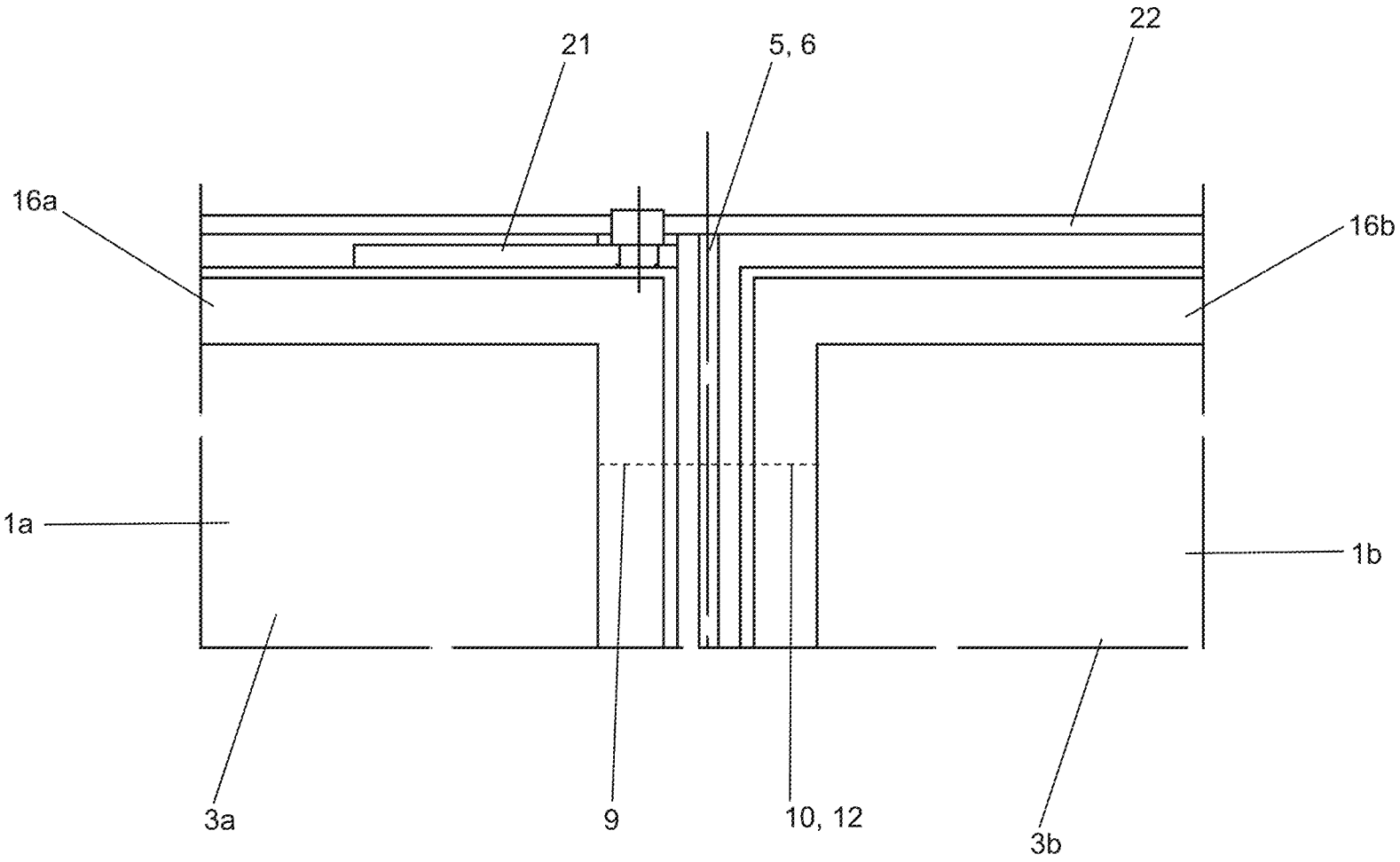
FIG. 4 shows a front view of the swing door system according to FIG. 3 mounted to a mounting frame.

FIGS. 3 and 4 show another embodiment of a swing door system 2. The swing door system 2 comprises two adjacent swing doors 1*a*, 1*b*. Each swing door 1*a*, 1*b* includes transparent panes 3*a*, 3*b* being spaced from each other by spacers 4*a*, 4*b*. Furthermore, a mullion 5 is arranged. The mullion 5 is T-shaped and comprises a part 6 that reaches between the adjacent swing doors 1*a*, 1*b*, when the swing doors 1*a*, 1*b* are in the closed position. It is possible that part 6 is shorter, so that it does not reach in between the adjacent swing doors 1*a*, 1*b*. The depth 30 of the mullion 5 is shorter than the depth 11 of the non-transparent region 9. The width 31 of the mullion 5 equals the width 12 of the non-transparent region 9. The mullion further comprises sealing surfaces 7*a*, 7*b* onto which the gaskets 8*a*, 8*b* are fixed, for example glued or snapped into. The adjacent swing doors include wedges 23*a*, 23*b* that are made of a material that interacts with the magnets 13*a*, 13*b* of the gaskets. For example, the wedges 23*a*, 23*b* are made of steel. The sealing surfaces 7*a*, 7*b* of the mullion 5 are inclined with respect to the transparent panes 3*a*, 3*b* when the adjacent swing doors 1*a*, 1*b* are in the closed position. Hence, shear forces acting on the gaskets 8*a*, 8*b* are minimized when the swing doors 1*a*, 1*b* are opened, i.e. when the magnets 13*a* 13*b* are disconnected from the wedges 23*a*, 23*b*. Furthermore, due to the design of the mullion 5 the horizontal diameter 10 of the non-transparent region 9 is minimized, especially the depth 11 and the width 12. Furthermore the design of the mullion 5 avoids shear forces acting on the gasket during the initial phase when opening the swing doors are minimized.

FIG. 4 further shows that the left swing door 1 comprises a hinge element 21, such that the swing door 1*a* can be rotatable mounted to horizontal profile 22 of an outer frame. The right swing door 1*b* can comprise a hinge on its not shown right side.

Figure 5:
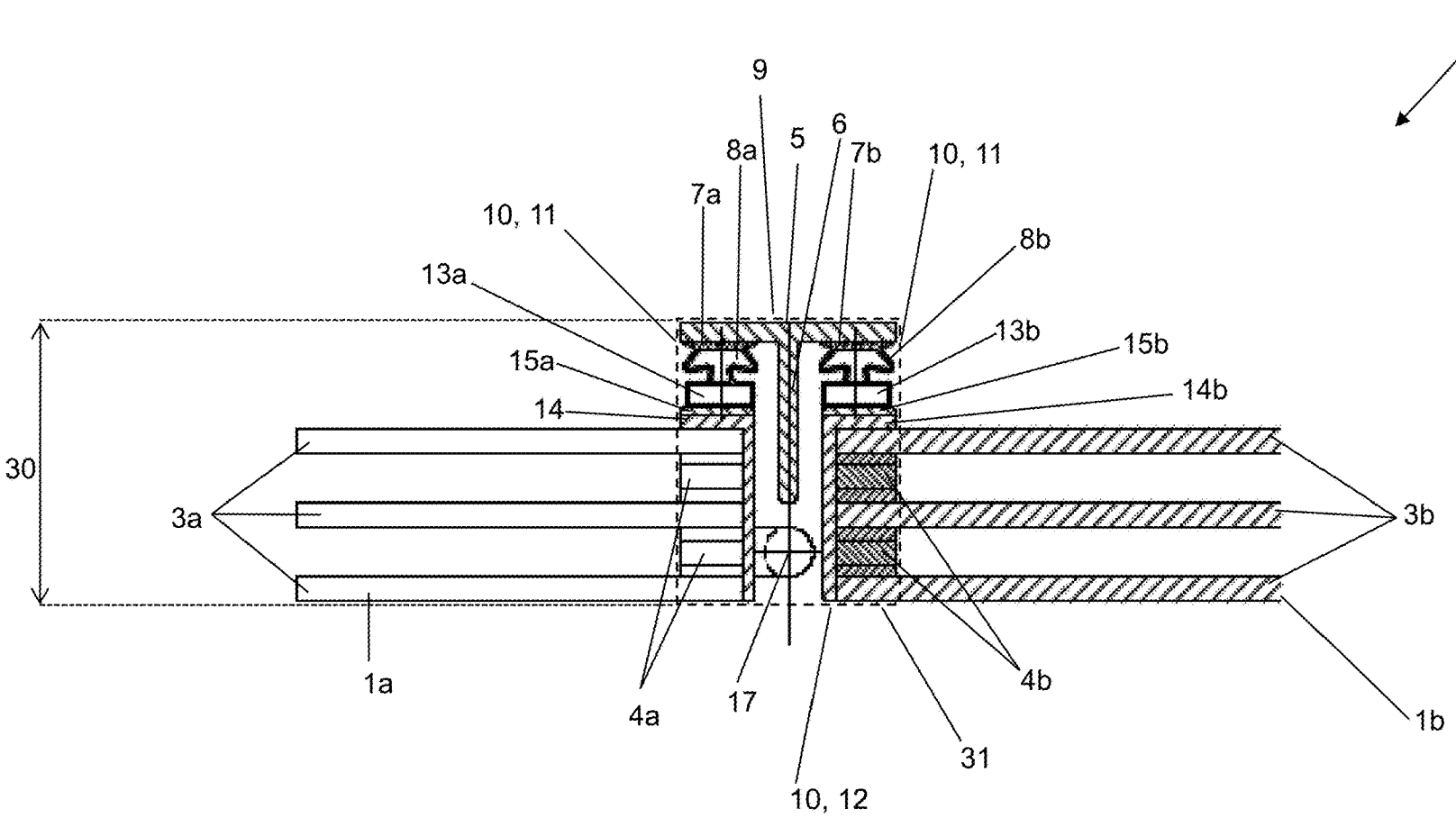
FIG. 5 shows a horizontal cross-sectional view of a swing door system according to a further embodiment of the present disclosure.
Figure 6:
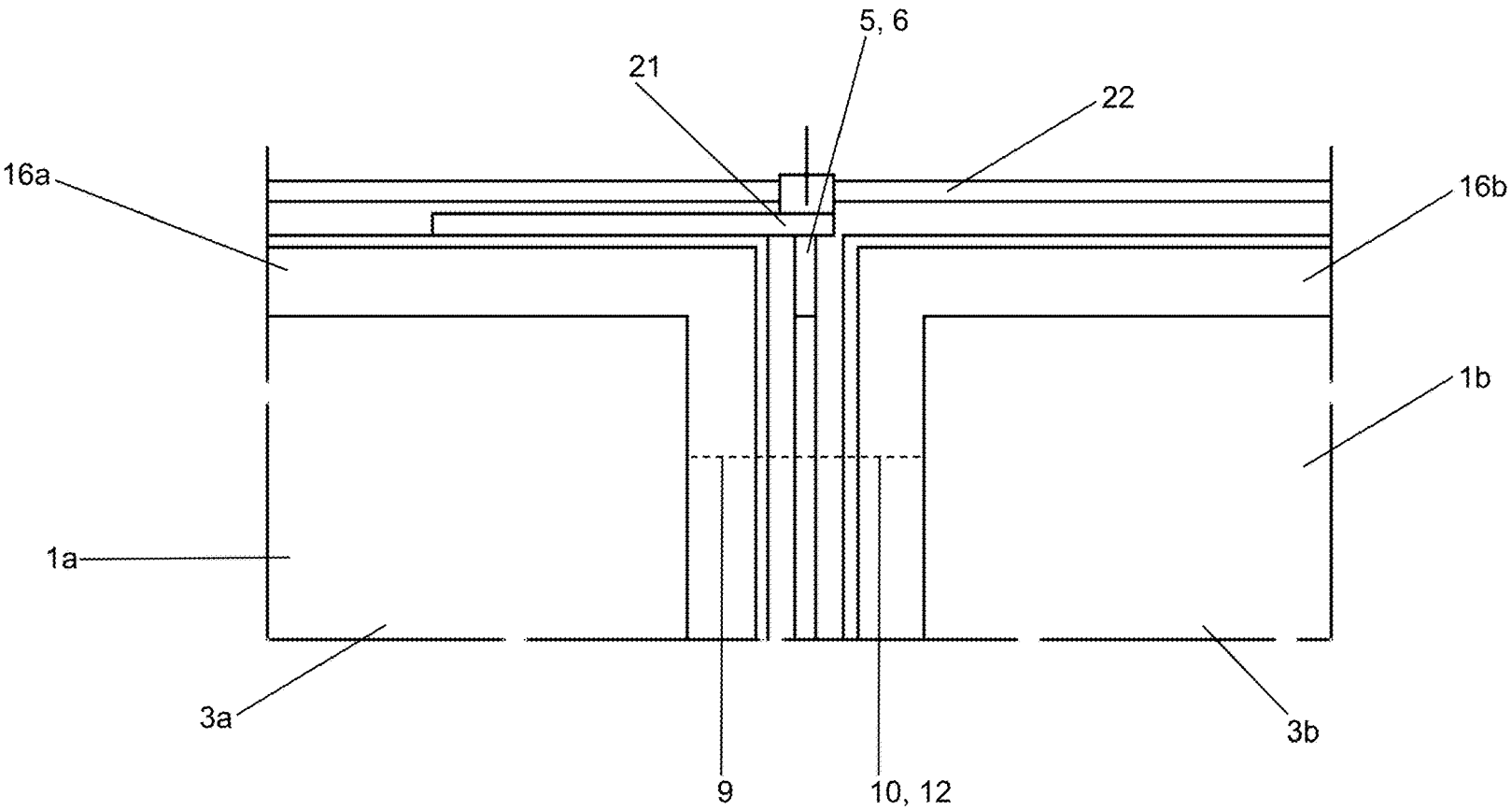
FIG. 6 shows a front view of the swing door system according to FIG. 5 mounted to a mounting frame.

FIGS. 5 and 6 show another embodiment of a swing door system 2. The swing door system 2 comprises two adjacent swing doors 1*a*, 1*b*. Each swing door 1*a*, 1*b* includes transparent panes 3*a*, 3*b* being spaced from each other by spacers 4*a*, 4*b*. Furthermore, a mullion 5 is arranged. The mullion 5 is T-shaped and comprises a part 6 that reaches between the adjacent swing doors 1*a*, 1*b*, when the swing doors 1*a*, 1*b* are in the closed position. The depth 30 of the mullion 5 is shorter than the depth 11 of the non-transparent region 9. The width 31 of the mullion 5 equals the width 12 of the non-transparent region 9. Hence, the swing door system 2 according to FIGS. 5 and 6 corresponds to the embodiment shown in FIGS. 1 and 2. In contrast to the embodiment of FIGS. 1 and 2, the rotating axis of the left door 1*a* is arranged between the adjacent swing doors 1*a*, 1*b*. Hence, shear forces are minimized that are acting on the gaskets 8*a*, 8*b* when the swing doors 1*a*, 1*b* are opened and the right door 1*b* is prevented from blocking the left door 1*a*, when the left door 1 is opened.

FIG. 6 further shows that the left swing door 1 comprises a hinge 21, such that the swing door 1*a* can be rotatable mounted to a horizontal profile 22 of an outer frame. The right swing door 1*b* can comprise a hinge on its not shown right side.

Figure 7:
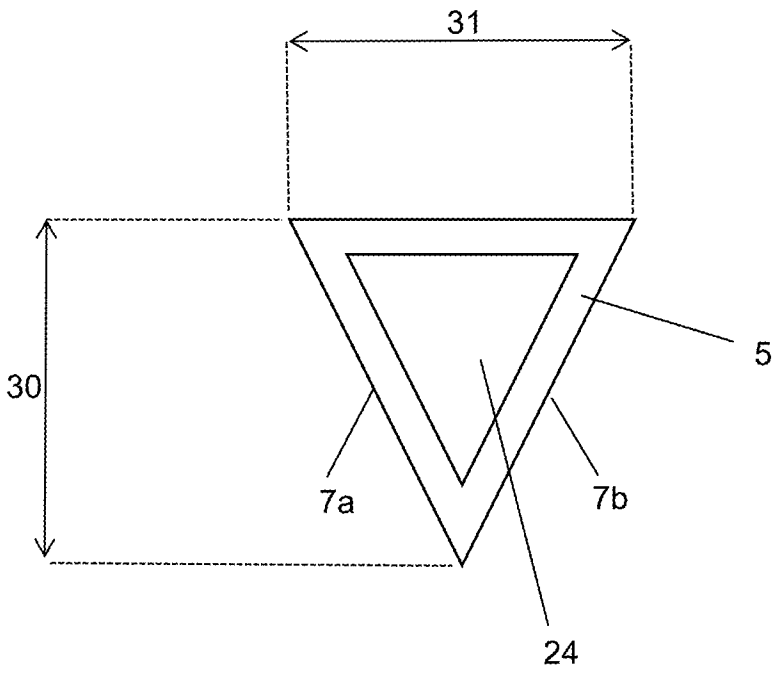
FIG. 7 shows a horizontal cross-sectional view of a mullion according to a further embodiment of the present disclosure.

FIG. 7 shows a cross-sectional view parallel to the opening direction of a mullion 5 according to a further embodiment of the present disclosure. The mullion 5 has a triangle shaped cross section. Therefore, the sealing surfaces 7*a*, 7*b* of the mullion 5 are inclined with respect to the not shown transparent pane of the adjacent swing doors when the swing doors are in the closed position. A triangle shaped mullion 5 has the advantage that the inner part 24 of the mullion 5 can serve as a cable duct, heat pipes, heating elements or other elements.

Figure 8:
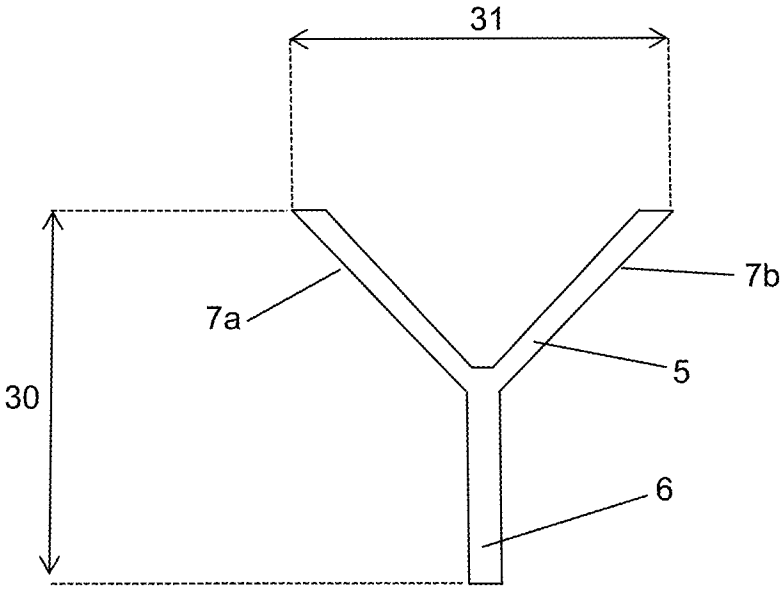
FIG. 8 shows a horizontal cross-sectional view of a mullion according to a further embodiment of the present disclosure.

FIG. 8 shows a cross-sectional view parallel to the opening direction of a mullion 5 according to a further embodiment of the present disclosure. The mullion 5 has a Y-shaped cross section. Therefore, the sealing surfaces 7*a*, 7*b* of the mullion 5 are inclined with respect to the not shown pane of the adjacent swing doors when the swing doors are in the closed position. The part 6 of the Y-shaped mullion 5 can reach in between the not shown adjacent swing doors. Furthermore, part 6 can be realized shorter, such that it does not reach in between the adjacent swing doors.

Figure 9:
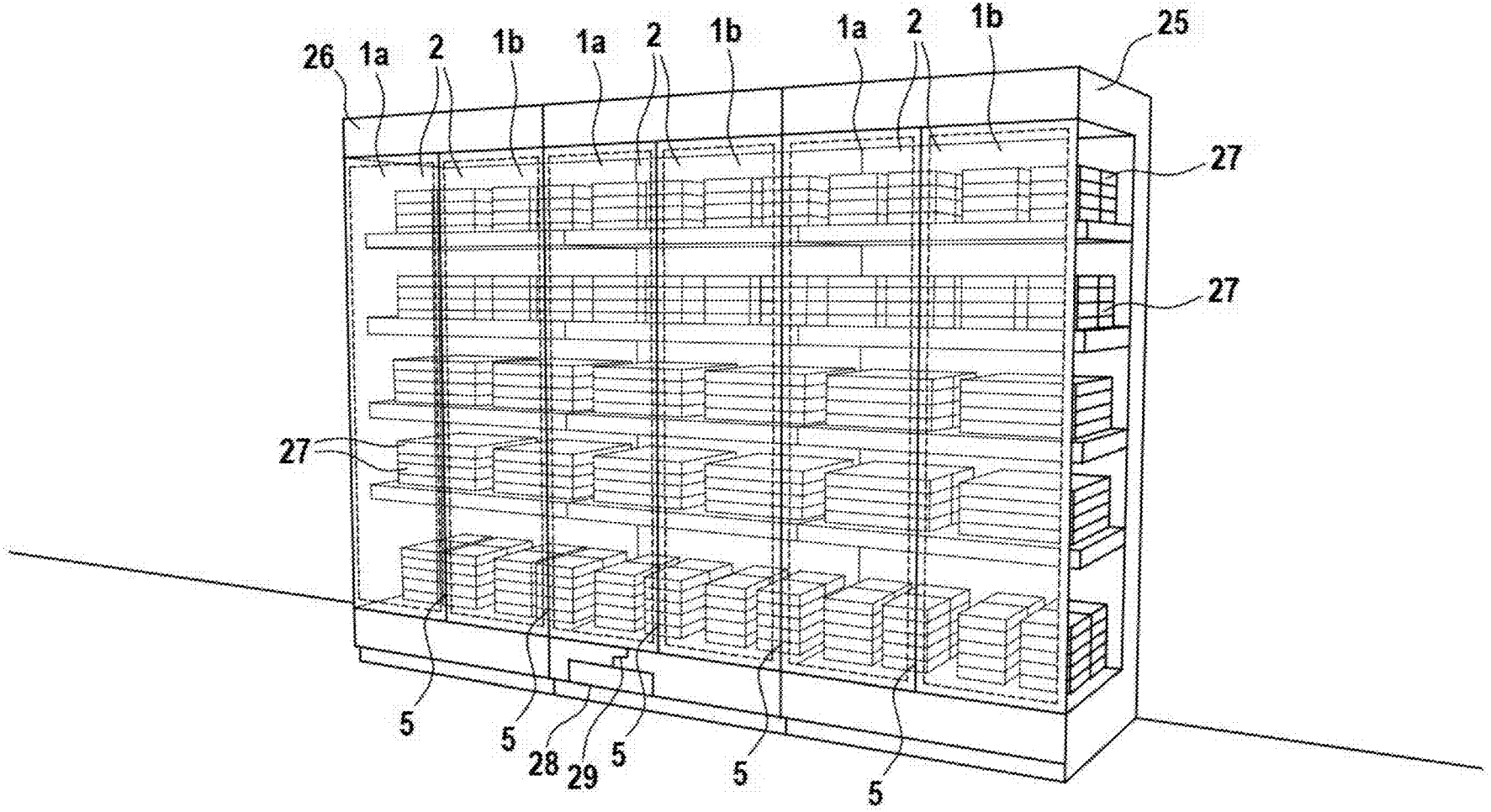
FIG. 9 shows a perspective view of a freezer device according to an embodiment of the present disclosure.

FIG. 9 shows a perspective view of a freezer device 25 according to an embodiment of the present disclosure. The freezer device 25 comprises a cabinet 26 and three swing door systems 2 each including two adjacent swing doors 1*a*, 1*b* and a mullion 5. The customer or person can see the products 27 through the transparent panes 3*a*, 3*b* of the swing doors 1*a*, 1*b*. Due to the low depth 11 and low width 12 of the non-transparent region 9, the person's view of the products 27 is improved when the person is viewing slantwise into the freezer device 2. Furthermore, the low width 12 of the non-transparent region 9 improves the view on the products 27, when the person stands in front of the freezer device 2.

Further, the freezer device 2 comprises an energy source 28 that is connected with an interface 29, which enables to provide energy to a heating element and/or light elements inside the swing doors 1*a*, 1*b*.

Figure 10:
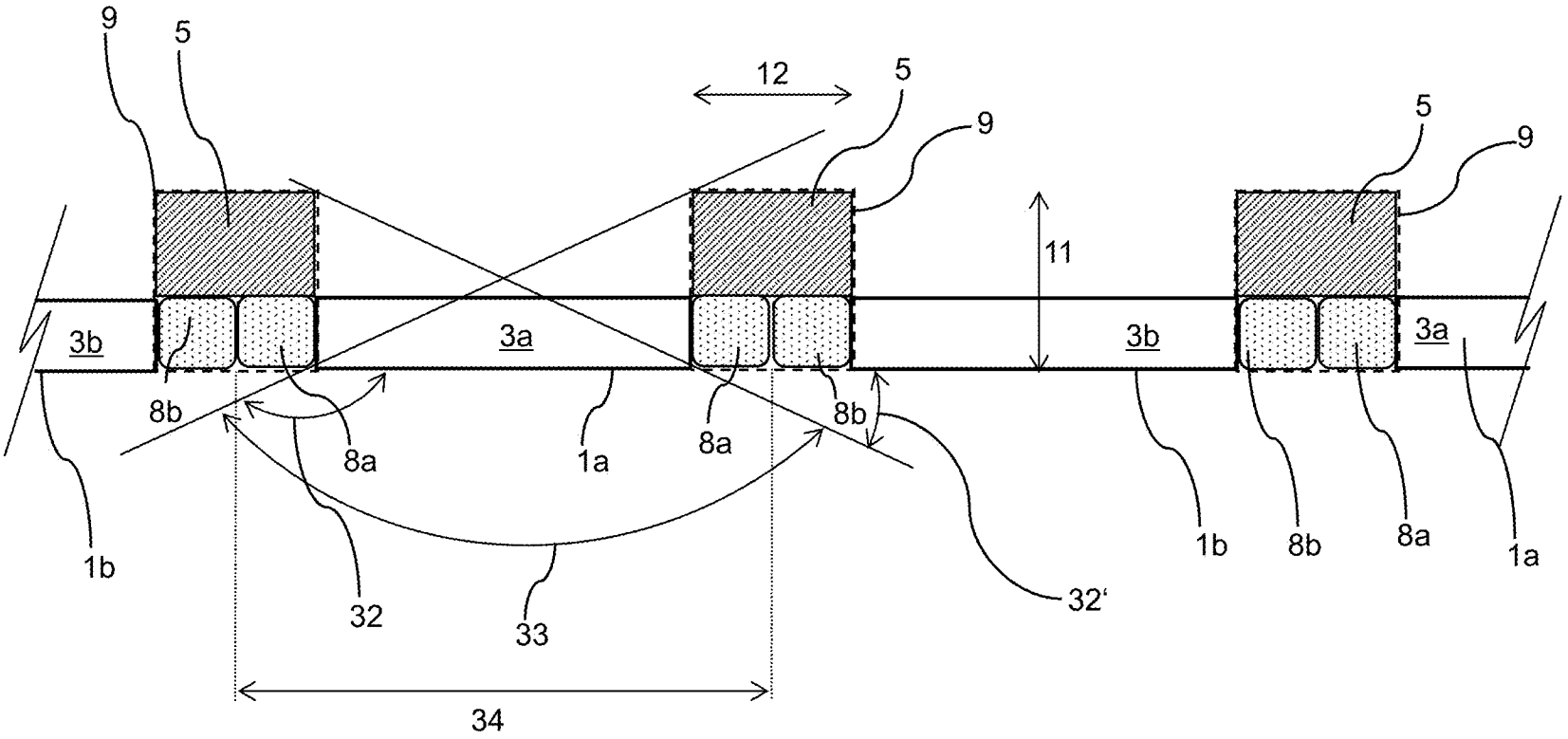
FIG. 10 shows a horizontal cross-sectional view of a swing door system.

Without being considered limiting with respect to the embodiment shown, FIG. 10 serves to illustrate the plurality of horizontal see-through angles 33. FIG. 10 shows several adjacent swing doors 1*a*, 1*b*, each comprising a transparent pane 3*a*, 3*b* and a gasket 8*a*, 8*b*. The skilled person will understand that the shown element 8*a*, 8*b* being described as a gasket is not limited as such and can therefore be any element defining the corresponding portion of the non-transparent region, for example a profile, a print or the like. Further, FIG. 10 shows mullions 5 being in contact with two of the adjacent swing doors 1*a*, 1*b*. The mullion 5 and the swing doors 1*a*, 1*b* define non-transparent regions 9. It should be noted that on the very left and/or the very right of a freezer device the non-transparent region 9 could be defined by a vertical side and the swing door 1*a*, 1*b* being in contact with this vertical side.

Further, FIG. 10 shows the maximum see-through angle 32 and the minimum see-through angle 32'. A view through the transparent pane 3*a* is not blocked by the non-transparent region 9 under a plurality of horizontal see-through angles 33 that range from the maximum see-through angle 32 to the minimum see-through angle 32'. Under a viewing angle bigger than the maximum see-through angle 32 or smaller than the minimum see-through angle 32' the view through the transparent pane 3*a* is totally blocked by the non-transparent region 9.

The maximum and minimum see-through angles 32, 32' depend on the width 34 of the swing door 1*a*, the width 12 of the non-transparent region 9 and the depth 11 of the non-transparent region 9.

Figure 11:
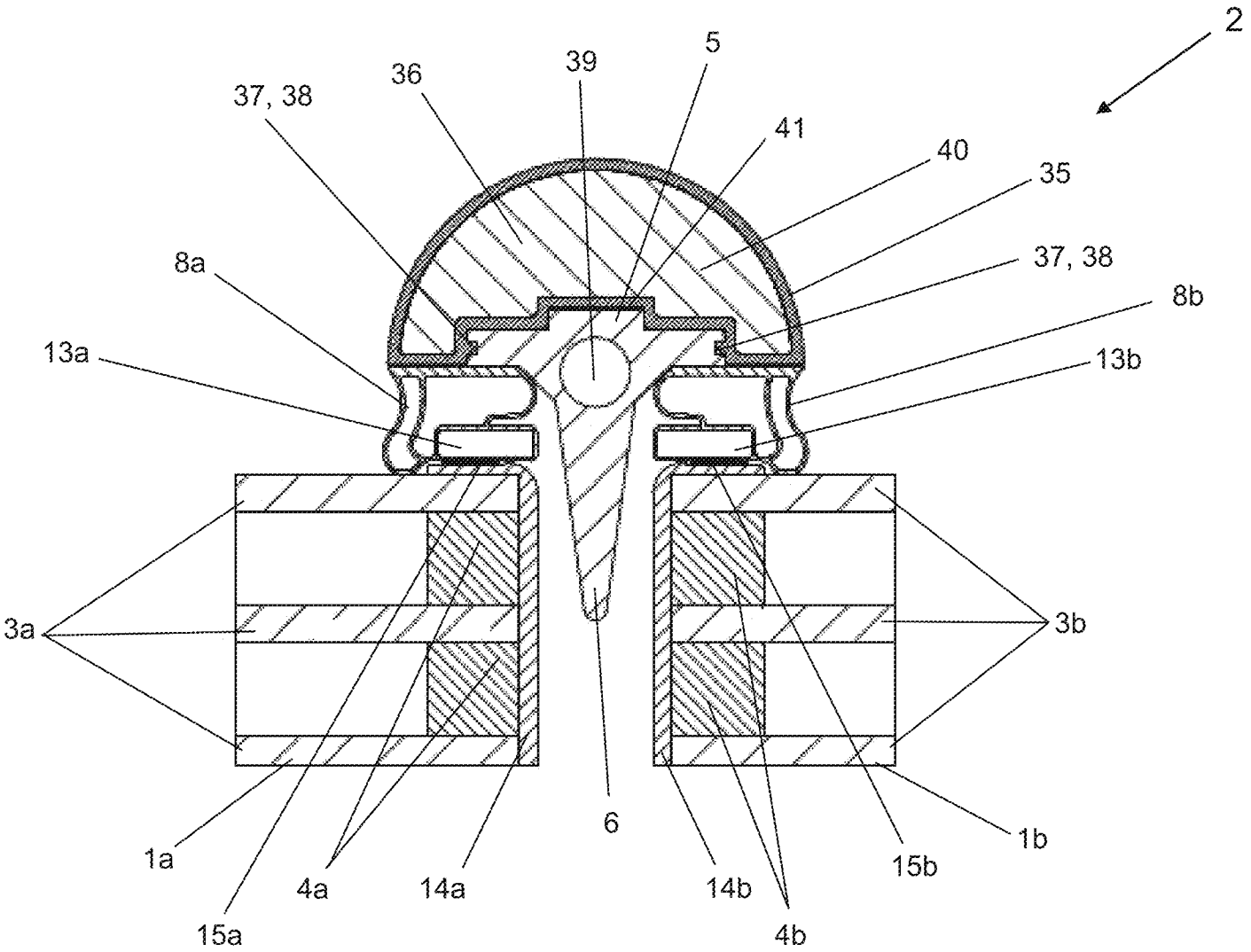
FIG. 11 shows a horizontal cross-sectional view of a swing door system according to a further embodiment of the present disclosure.

FIG. 11 shows another embodiment of a swing door system 2. The swing door system 2 comprises two adjacent swing doors 1*a*, 1*b*. Each swing door 1*a*, 1*b* includes transparent panes 3*a*, 3*b* being spaced from each other by spacers 4*a*, 4*b*. Furthermore, a mullion 5 is arranged.

The mullion 5 is essentially triangle shaped and comprises a part 6 that reaches between the adjacent swing doors 1*a*, 1*b*, when the swing doors 1*a*, 1*b* are in the closed position. It is possible that part 6 is shorter, so that it does not reach in between the adjacent swing doors 1*a*, 1*b* but at least points in this direction. Further, an insulation profile 35 is connected or attached to the mullion 5. The insulation profile 35 comprises a space 40 that is filled with a thermally insulating material 36. In this embodiment, the space 40 is defined by a cavity, such that the insulation profile 35 is a hollow profile. The insulation profile 35 is firmly bonded to the mullion 5 with bonding material 41, for example with an adhesive tape. The insulation profile 35 can be attached at different fixation points or over its whole length to the mullion 5. Additionally, the insulation profile 35 comprises protuberances 37 that fit into recesses 38 of the mullion 5 for providing a force-fit and/or form-fit connection.

The mullion 5 further comprises a passage 39 for mounting the mullion 5 to the horizontal profiles, for example with screws.

Each of the swing doors 1*a*, 1*b* comprises an L-shaped profile 14*a*, 14*b*, respectively. Moreover, gaskets 8*a*, 8*b* are attached to the mullion 5 and the insulation profile 35. When the swing doors 1*a*, 1*b* are in the closed position the gaskets 8*a*, 8*b*, respectively, form a barrier between the mullion 5 and the interior of the freezer. Additionally, the gaskets 8*a*, 8*b* are arranged such as to form a barrier between the L-shaped profiles 14*a*, 14*b* and the interior of the freezer when the swing doors 1*a*, 1*b* are in the closed position. By providing these two barriers, a very good thermal insulation is achieved such that a heating of the swing doors 1*a*, 1*b* is not necessary.

Further, each of the gaskets 8*a*, 8*b* comprises a magnet 13*a*, 13*b*. Moreover, the L-shaped profile 14*a*, 14*b* comprises a layer 15*a*, 15*b* of a material, preferably of metal, for example of steel, that interacts with the magnets 13*a*, 13*b* when the swing doors 1*a*, 1*b* are in the closed position. Thereby the swing doors 1*a*, 1*b* are held securely in the closed position so that the sealing of the inside of the freezer device is improved and the swing doors 1*a*, 1*b* can still be opened easily. Instead of providing a layer 15*a*, 15*b* the L-shaped profile 14*a*, 14*b* itself can be made of such a material that interacts with the magnets 13*a*, 13*b*.

Many modifications and other embodiments of the disclosure set forth herein will come to mind to the one skilled in the art to which the disclosure pertains having the benefit of the teachings presented in the foregoing description and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

LIST OF REFERENCE SIGNS

1*a*, 1*b* swing door
2 swing door system
3*a*, 3*b* transparent pane
4*a*, 4*b* Spacer
5 Mullion
6 Part
7*a*, 7*b* sealing surface
8*a*, 8*b* gasket
9 non-transparent region
10, 10' horizontal diameter
11 depth (non-transparent region)
12 width (non-transparent region)
13*a*, 13*b* magnet
14*a*, 14*b* profile
15*a*, 15*b* layer
16*a*, 16*b* print
17 rotating axis
18 distance
19 thickness
20 gap
21 hinge
22 horizontal profile
23*a*, 23*b* wedge
24 inner part (mullion)
25 freezer device
26 cabinet
27 product
28 energy source
29 interface
30 depth
31 width
32, 32' minimum/maximum see-through angle
33 plurality of see through angles
34 width (swing door)
35 insulation profile
36 thermally insulation material
37 protuberance
38 recess
39 passage
40 space
41 bonding material

The invention claimed is:

1. A swing door system, comprising:

two adjacent swing doors;

a mullion in contact with the swing doors; and an insulation profile attached to the mullion, wherein the insulation profile comprises a space that is filled with a thermally insulating material, wherein the insulation profile comprises at least partly a C-shaped cross-section, wherein each swing door comprises a transparent pane and a non-transparent area, wherein each non-transparent area is proximal to the mullion when the swing doors are in a closed position, wherein each non-transparent area and the mullion define a non-transparent region, wherein the transparent panes have a view therethrough that is not totally blocked by the non-transparent region along a plurality of horizontal see-through angles, and wherein each of the horizontal see-through angles is measured with respect to a plane of the swing doors when the swing doors are in the closed position, wherein at least one of the swing doors has a width from 500 mm to 1000 mm, wherein when the width is in the range of 500 mm to 780 mm, the plurality of horizontal see-through angles range from 6° to 174°, and wherein when the width is in the range of greater than 780 mm and equal to or less than 1000 mm, the plurality of horizontal see-through angles range from 5° to 175°.

2. The swing door system according to claim 1, wherein the non-transparent region has a depth that is less than 70 mm.

3. The swing door system according to claim 1, wherein the non-transparent region has a width that is less than 70 mm.

4. The swing door system according to claim 1, wherein the mullion has a cross-section, and the cross-section is selected from the group consisting of T-shaped, Y-shaped, and triangle-shaped, and/or wherein the mullion is integrally formed at least in the region that extends from a bottom to a top of the two adjacent swing doors.

5. The swing door system according to claim 1, wherein the mullion comprises two elements that are coupled to each other with a connection selected from the group consisting of form-fit, force-fit, bonding, and any combinations thereof, at least in the region that extends from a bottom to a top of the two adjacent swing doors.

6. The swing door system according to claim 1, wherein the mullion comprises a cavity.

7. The swing door system according to claim 1, wherein the mullion is solid.

8. The swing door system according to claim 1, wherein the mullion comprises a part that reaches in between the two adjacent swing doors when the swing doors are in the closed position.

9. The swing door system according to claim 1, wherein the insulation profile is attached to the mullion with a connection selected from the group consisting of form-fit, force-fit, bonding, and any combinations thereof.

10. The swing door system according to claim 1, wherein the insulation profile is made of plastic.

11. The swing door system according to claim 1, wherein the mullion comprises at least two sealing surfaces, and wherein each of the two sealing surfaces is inclined with respect to a plane of the swing doors when the swing doors are in the closed position.

12. The swing door system according to claim 1, further comprising a gasket attached to the mullion and/or a gasket attached to the insulation profile.

13. The swing door system according to claim 12, wherein the gasket and the insulation profile form a barrier between the mullion and an interior of a freezer when the adjacent swing doors are in the closed position.

14. The swing door system according to claim 12, wherein each swing door is at least partly surrounded by a profile.

15. The swing door system according to claim 14, wherein the gasket forms a barrier between the profile and an interior of a freezer when the adjacent swing doors are in the closed position.

16. The swing door system according to claim 1, further comprising a gasket attached to at least one of the swing doors.

17. The swing door system according to claim 1, further comprising magnets for magnetically connecting the swing doors to the mullion when the doors are in the closed position, and/or wherein the transparent pane of the swing door comprises a gas-filled insulating glass unit or a vacuum insulated glass unit, and/or wherein at least one of the swing doors comprises printing on at least a portion thereof in the non-transparent region.

18. The swing door system according to claim 1, wherein the mullion is made of a material selected from the group consisting of metal plastic, plastic coated metal, and plastic coated steel, and/or wherein the swing door system does not comprise any heaters for heating at least a part of the swing doors and/or wherein the swing door system comprises heaters for heating at least a part of the mullion and/or at least a part of a horizontal profile, and/or wherein the swing door system comprises lights for lighting at least a part of a cabinet.

19. The swing door system according to claim 1, wherein the swing doors have a rotating axis, and the rotating axis of at least one of the swing doors is in the non-transparent region, and/or wherein the rotating axis of at least one of the swing doors is off-center with respect to a depth of the non-transparent region, and/or wherein the rotating axis of at least one of the swing doors is in the area between the adjacent swing doors.

20. The swing door system according to claim 1, wherein at least one of the swing doors comprises a hinge at opposite ends of the at least one swing door.

21. A freezer device comprising at least one swing door system according to claim 1, wherein the freezer device is in a cabinet, such that an opening direction of the swing door system is horizontal.

22. A swing door system, comprising:

two adjacent swing doors; and a mullion in contact with the swing doors, wherein the mullion comprises a part that reaches in between the two adjacent swing doors when the swing doors are in the closed position, wherein each swing door comprises a transparent pane and a non-transparent area, and wherein each non-transparent area is proximal to the mullion when the swing doors are in a closed position, wherein each non-transparent area and the mullion define a non-transparent region, wherein the transparent panes have a view therethrough that is not totally blocked by the non-transparent region along a plurality of horizontal see-through angles, and wherein each of the horizontal see-through angles is measured with respect to a plane of the swing doors when the swing doors are in the closed position, wherein at least one of the swing doors has a width from 500 mm to 1000 mm, wherein when the width is in the range of 500 mm to 780 mm, the plurality of horizontal see-through angles range from 6° to 174°, and wherein when the width is in the range of greater than 780 mm and equal to or less than 1000 mm, the plurality of horizontal see-through angles range from 5° to 175°.

* * * * *